US011730250B2

(12) United States Patent
Hwang

(10) Patent No.: US 11,730,250 B2
(45) Date of Patent: Aug. 22, 2023

(54) REFILLABLE COSMETIC CONTAINER

(71) Applicant: F.S.KOREA INDUSTRIES INC., Seoul (KR)

(72) Inventor: Jae Kwang Hwang, Seoul (KR)

(73) Assignee: F.S.KOREA INDUSTRIES INC., Seoul (KR)

( * ) Notice: Subject to any disclaimer, the term of this patent is extended or adjusted under 35 U.S.C. 154(b) by 0 days.

(21) Appl. No.: 17/574,322

(22) Filed: Jan. 12, 2022

(65) Prior Publication Data

US 2022/0218088 A1 Jul. 14, 2022

(30) Foreign Application Priority Data

Jan. 14, 2021 (KR) ..... 10-2021-0005331

(51) Int. Cl.
*A45D 34/00* (2006.01)
*B05B 11/10* (2023.01)

(52) U.S. Cl.
CPC ..... *A45D 34/00* (2013.01); *B05B 11/1042* (2023.01); *B05B 11/1069* (2023.01); *A45D 2034/005* (2013.01); *A45D 2200/055* (2013.01)

(58) Field of Classification Search
CPC ..... A45D 34/00; A45D 2034/005; A45D 2200/055; A45D 34/04; A45D 2200/056; B05B 11/3042; B05B 11/3069; B05B 11/0038; B05B 11/0097; B05B 11/3067; B05B 11/3001; B05B 11/3023; B05B 11/3074; B05B 11/3053; B05B 11/3059; B05B 11/306; B65D 77/20
See application file for complete search history.

(56) References Cited

U.S. PATENT DOCUMENTS 5,477,985 A * 12/1995 Gueret ..... B05B 11/00412 383/107
9,089,868 B2 * 7/2015 Lee ..... B05B 11/309
2002/0025211 A1 * 2/2002 Gueret ..... B65D 83/0011 401/175
2003/0063945 A1 * 4/2003 Gueret ..... B65D 51/24 401/126
2020/0017272 A1 * 1/2020 Okude ..... B05B 11/0054
2022/0346529 A1 * 11/2022 Hwang ..... A45D 40/24

* cited by examiner

*Primary Examiner* — Vishal Pancholi
(74) *Attorney, Agent, or Firm* — Rabin & Berdo, P.C.

(57) ABSTRACT

Disclosed is a refillable cosmetic container including a container body provided with a main body of which an one side is opened; a refillable container part detachably coupled to the main body and in which a cosmetic liquid is stored; a support part coupled to the other side of the main body; and a pumping driving part coupled to the support part to discharge the cosmetic liquid stored in the refillable container part to the outside of the refillable container part, wherein the refillable container part includes a refillable container body detachably coupled to the main body and a shifter part detachably coupled to the refillable container body and penetrated with a tube member of the pumping driving part, and a film is provided between the refillable container body and the main body to be easily separated when the refillable container body is separated from the main body.

7 Claims, 7 Drawing Sheets

REFILLABLE COSMETIC CONTAINER

CROSS-REFERENCE TO RELATED APPLICATIONS

This application claims the priority of Korean Patent Application No. 10-2021-0005331 filed on Jan. 14, 2021, in the Korean Intellectual Property Office, the disclosure of which is incorporated herein by reference.

BACKGROUND OF THE INVENTION

Field of the Invention

The present disclosure relates to a cosmetic container, and more particularly, to a refillable cosmetic container capable of being easily refilled and installed and separating a film conveniently.

Description of the Related Art

In general, as a method of using liquid cosmetic contents such as cosmetics, which preferably use a small amount of eye cream and the like at a time, but use a precise quantity, in the related art, a method of individually packaging the contents in the form of a capsule or the like by an amount to be used for each use time was used.

However, such an individual packaging method has a problem in that it is inefficient because a relatively large amount thereof remains in the capsule even after a user uses the cosmetic contents.

In order to overcome the problems of such an individual packaging method, after the contents are received in a container, there is disclosed a configuration of extracting the cosmetic contents every use by using an extracting means having a general pipette or syringe structure or using an extracting means having a configuration of a push pump.

Meanwhile, when the cosmetic contents are extracted by using the extracting means of a conventional syringe structure, it is inconvenient because an area coupled with the piston is exposed to the outside of the container and it is unsanitary because foreign substances may be stained on the exposed area, so that the improvement thereof is required.

In particular, when the pressing force is applied by the user to automatically pump the cosmetic contents, the convenience of use may be improved, and therefore, measures for improvement are also required.

The above-described technical configuration is the background art for helping in the understanding of the present disclosure, and does not mean a conventional technology widely known in the art to which the present disclosure pertains.

SUMMARY OF THE INVENTION

Therefore, an object of the present disclosure is to provide a refillable cosmetic container capable of being easily refilled and installed and separating a film conveniently.

According to an aspect of the present disclosure, there is provided a refillable cosmetic container including: a container body provided with a main body of which an one side is opened; a refillable container part which is detachably coupled to the main body and in which a cosmetic liquid is stored; a support part which is coupled to the other side of the main body; and a pumping driving part which is coupled to the support part to discharge the cosmetic liquid stored in the refillable container part to the outside of the refillable container part, wherein the refillable container part includes a refillable container body detachably coupled to the main body and stored with the cosmetic liquid therein and a shifter part detachably coupled to the refillable container body and penetrated with a tube member of the pumping driving part, and a film is provided between the refillable container body and the main body to be easily separated when the refillable container body is separated from the main body.

The refillable cosmetic container may further include a body flange which is provided at a lower end of the refillable container body to support a lower end of the main body.

The shifter part may include shifter body coupled to the upper portion of the refillable container body to cover an open upper region of the refillable container body; and an extension body provided in the shifter body and penetrated with the tube member to cover a lower side of a housing of the pumping driving part and prevent the cosmetic liquid from being leaked.

The shifter part may further include a support flange provided at an edge of the shifter body to be supported on the upper end of the refillable container body.

The support part may include a base body which is detachably coupled to the body head of the main body to guide the elevation of a stem of the pumping driving part and limit an ascending height of a piston member of the pumping driving part; and an elevation guide cap which is coupled to the base body to guide the elevation of the discharge cap of the pumping driving part.

The support part may further include a support post provided on the base body to support an elastic member of the pumping driving part.

The pumping driving part may include the housing which is coupled to the support part and has a lower end which protrudes toward the bottom portion of the refillable container body by passing through the shifter part; the tube member which is coupled to the end of the housing to introduce the cosmetic liquid stored in the refillable container body into the housing or discharge the cosmetic liquid in the housing to the outside of the housing; the elastic member having one side supported on the support post of the support part; the stem of which one side is supported on the other side of the elastic member and the other side is supported and elevated on the base body of the support part; the piston base which has one end coupled to the stem and the other end disposed in the housing, and is provided with an inlet hole into which the cosmetic liquid is introduced; the piston member provided in the piston base to be in contact with the inner wall of the housing; the discharge cap which is coupled to the stem and supported and elevated on the elevation guide cap of the support part by an external force of the user, and is provided with a discharge passage through which the cosmetic liquid moving through the inlet hole is discharged to the outside; and a disk valve provided on an inner bottom portion of the housing.

The main body may be provided with a first inclined surface portion, the refillable container body may be provided with a second inclined surface portion, and when the refillable container body is coupled to the main body, the first inclined surface portion and the second inclined surface portion may be engaged with each other to prevent a gap between the main body and the refillable container body.

According to the embodiments of the present disclosure, the refillable container part includes a refillable container body detachably coupled to the inside of the main body and stored with the cosmetic liquid therein and a shifter part detachably coupled to the refillable container body and penetrated with a tube member of the pumping driving part, and a film is provided between the refillable container body and the main body to be separated together with the refillable container body when the refillable container body is separated from the main body, thereby easily separating and removing the film and easily replacing the refillable container part.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
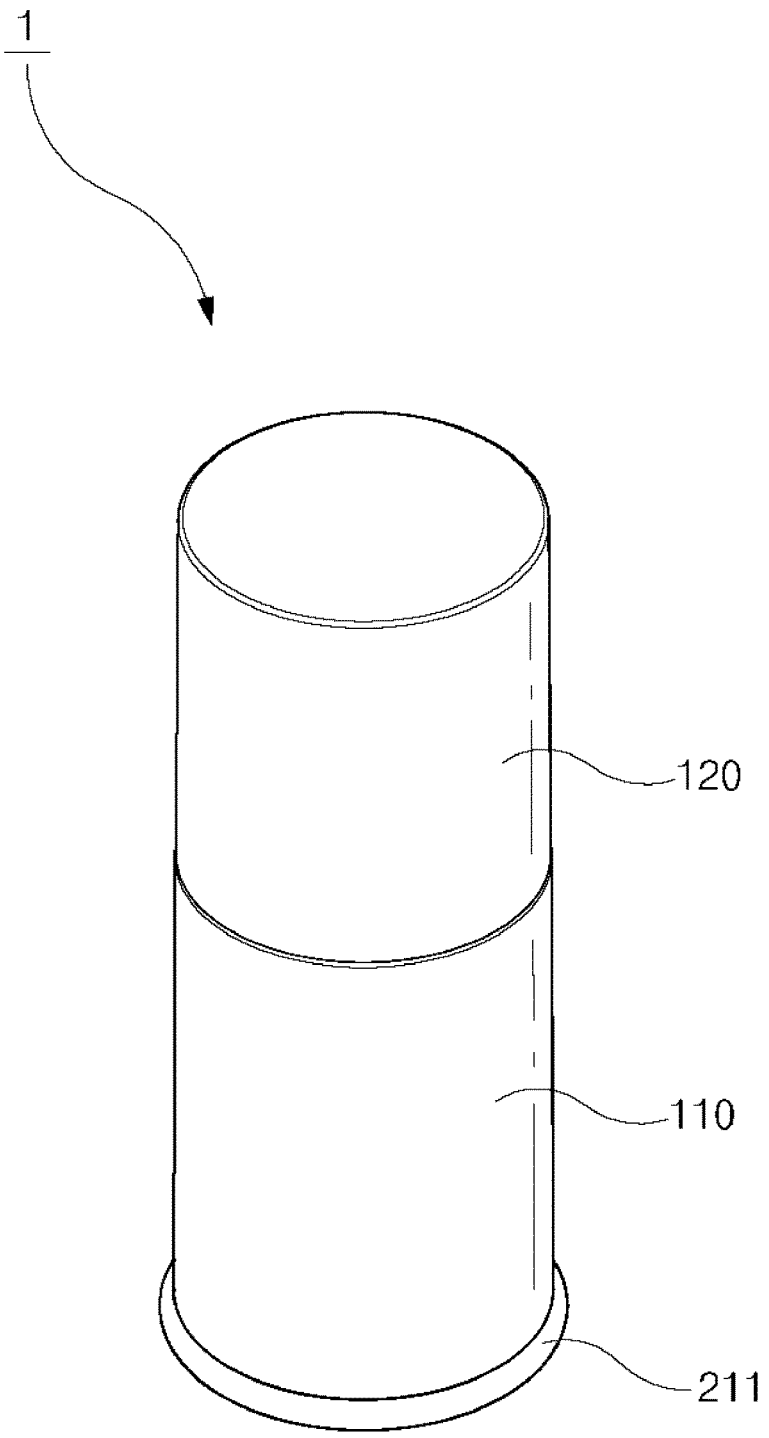
FIG. 1 is a diagram schematically illustrating a refillable cosmetic container according to an exemplary embodiment of the present disclosure.

In order to fully understand the present disclosure, operational advantages of the present disclosure and objects to be achieved by implementing the present disclosure, the present disclosure will be described with reference to the accompanying drawings which illustrate preferred embodiments of the present disclosure and the contents illustrated in the accompanying drawings.

Hereinafter, preferred embodiments of the present disclosure will be described in detail with reference to the accompanying drawings. Like reference numerals illustrated in the respective drawings designate like members.

Figure 2:
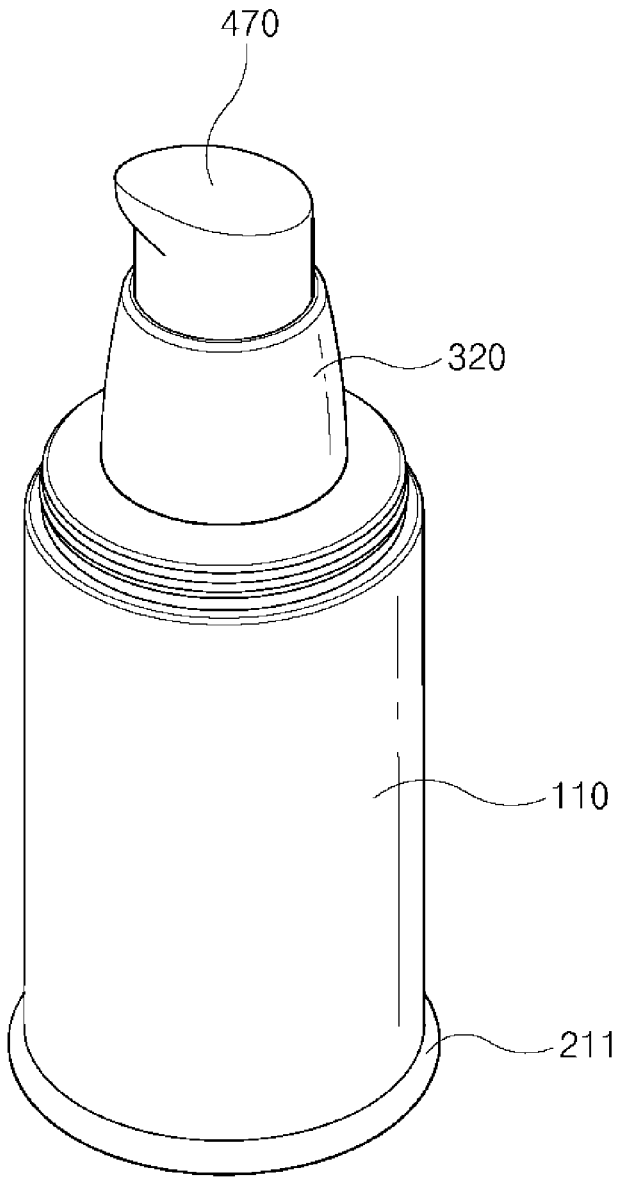
FIG. 2 is a diagram schematically illustrating a refillable cosmetic container except for a cap member in FIG. 1.
Figure 3:
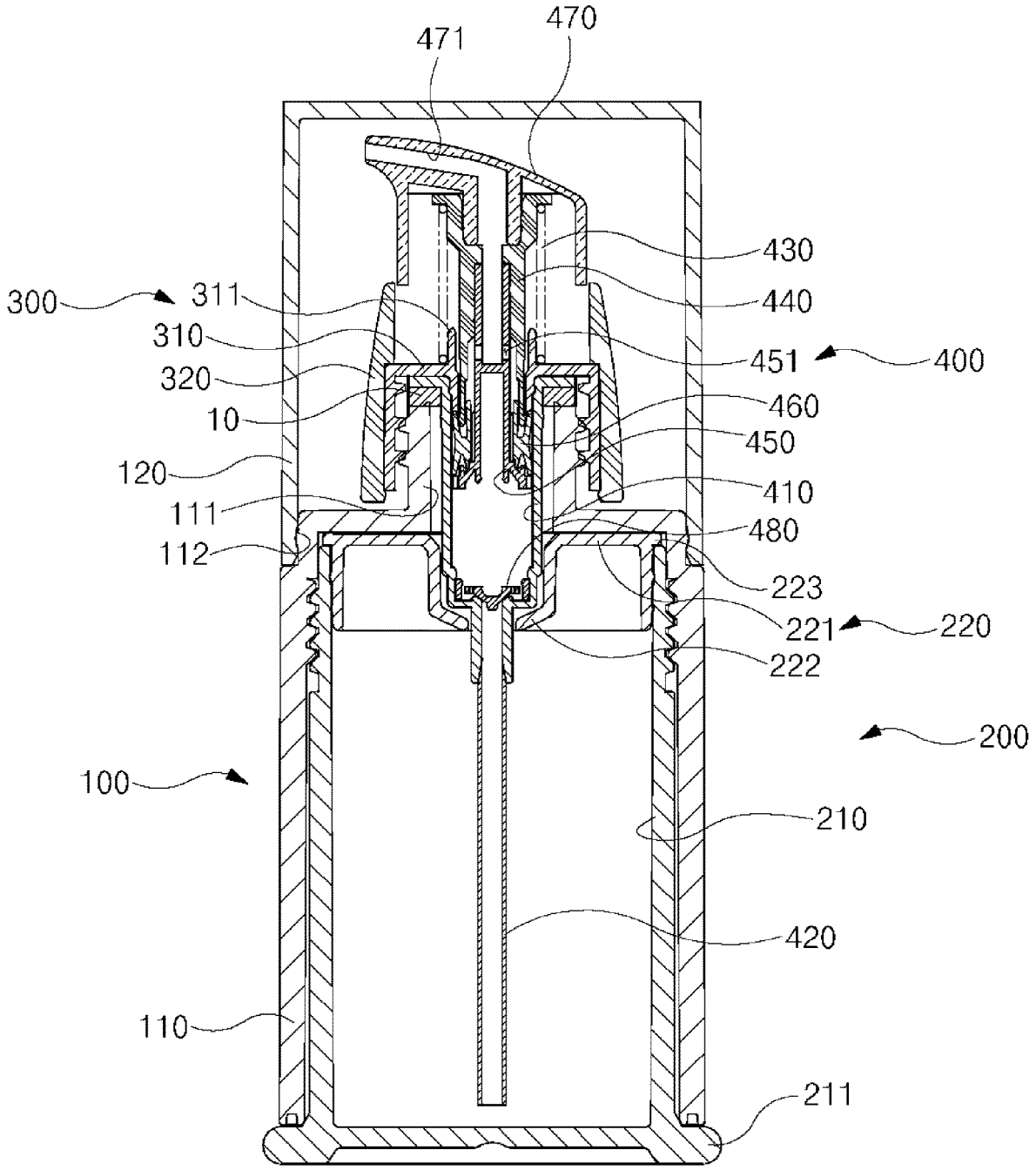
FIG. 3 is a cross-sectional view of FIG. 1.
Figure 4:
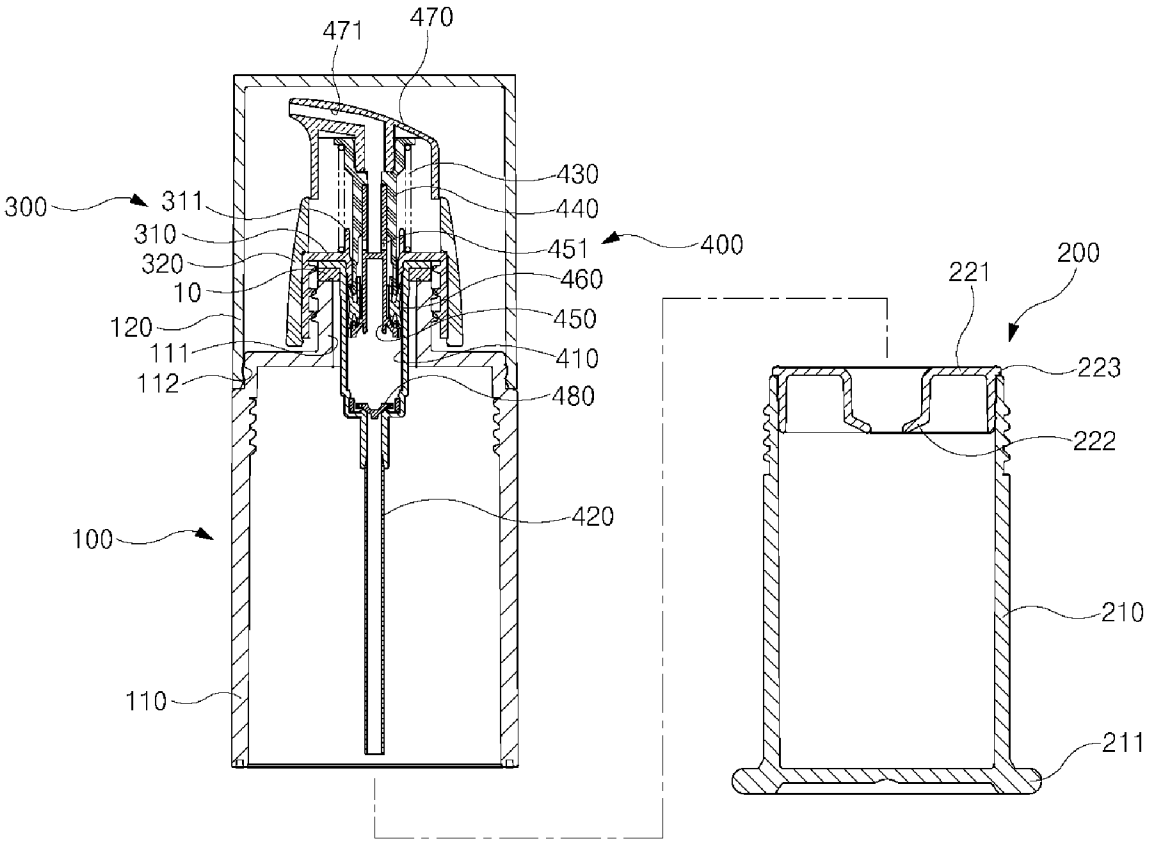
FIG. 4 is a diagram illustrating a state in which a refillable container part is separated in FIG. 3.

FIG. 1 is a diagram schematically illustrating a refillable cosmetic container according to an exemplary embodiment of the present disclosure, FIG. 2 is a diagram schematically illustrating a refillable cosmetic container except for a cap member in FIG. 1, FIG. 3 is a cross-sectional view of FIG. 1, and FIG. 4 is a diagram illustrating a state in which a refillable container part is separated in FIG. 3.

Figure 5:
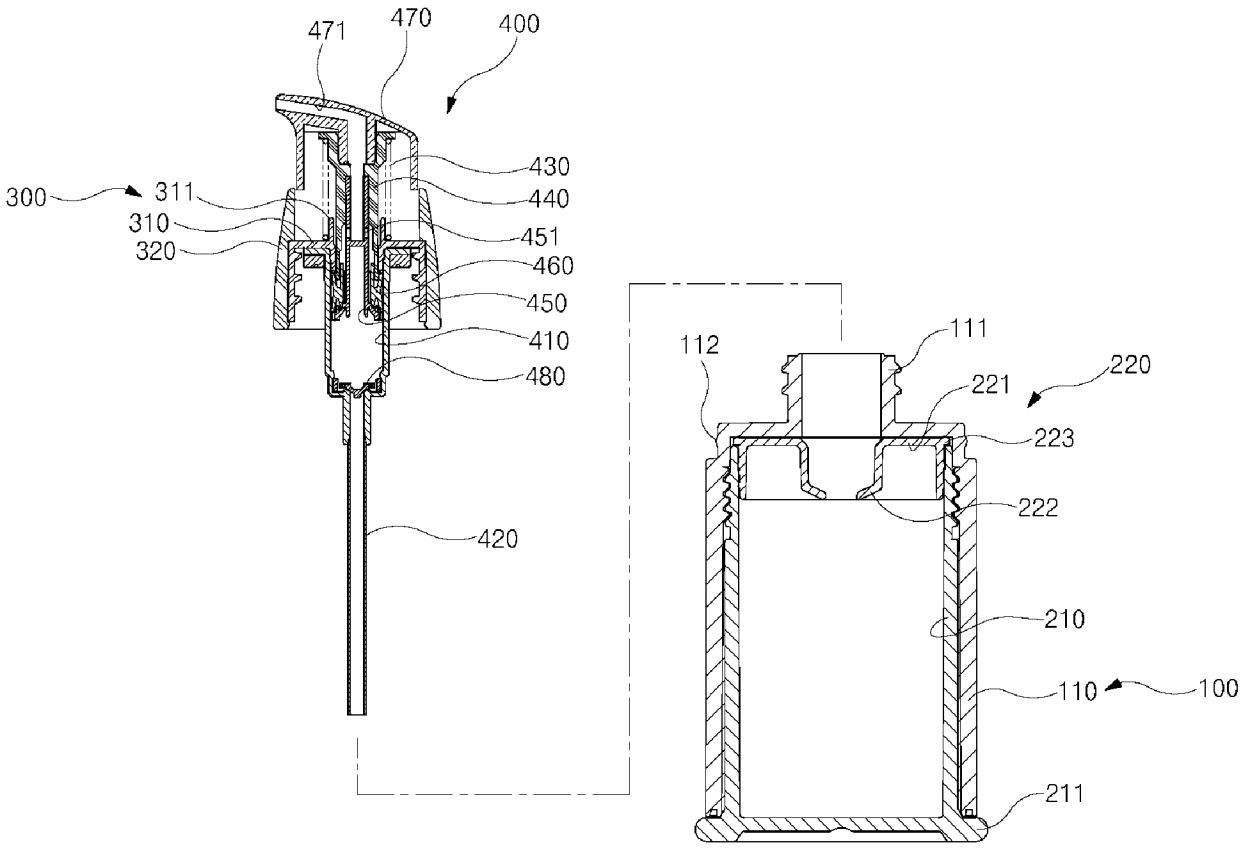
FIG. 5 is a diagram schematically illustrating a state where a support part and a pumping driving part are separated from a container body and a cap member is excluded in FIG. 3.
Figure 6:
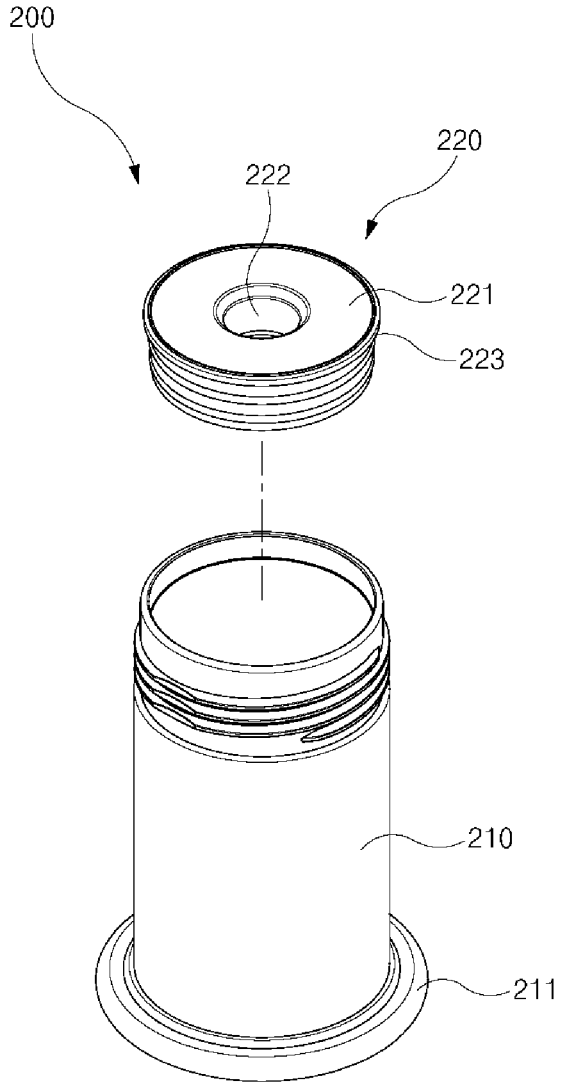
FIG. 6 is an exploded perspective view of the refillable container part illustrated in FIG. 4.
Figure 7:
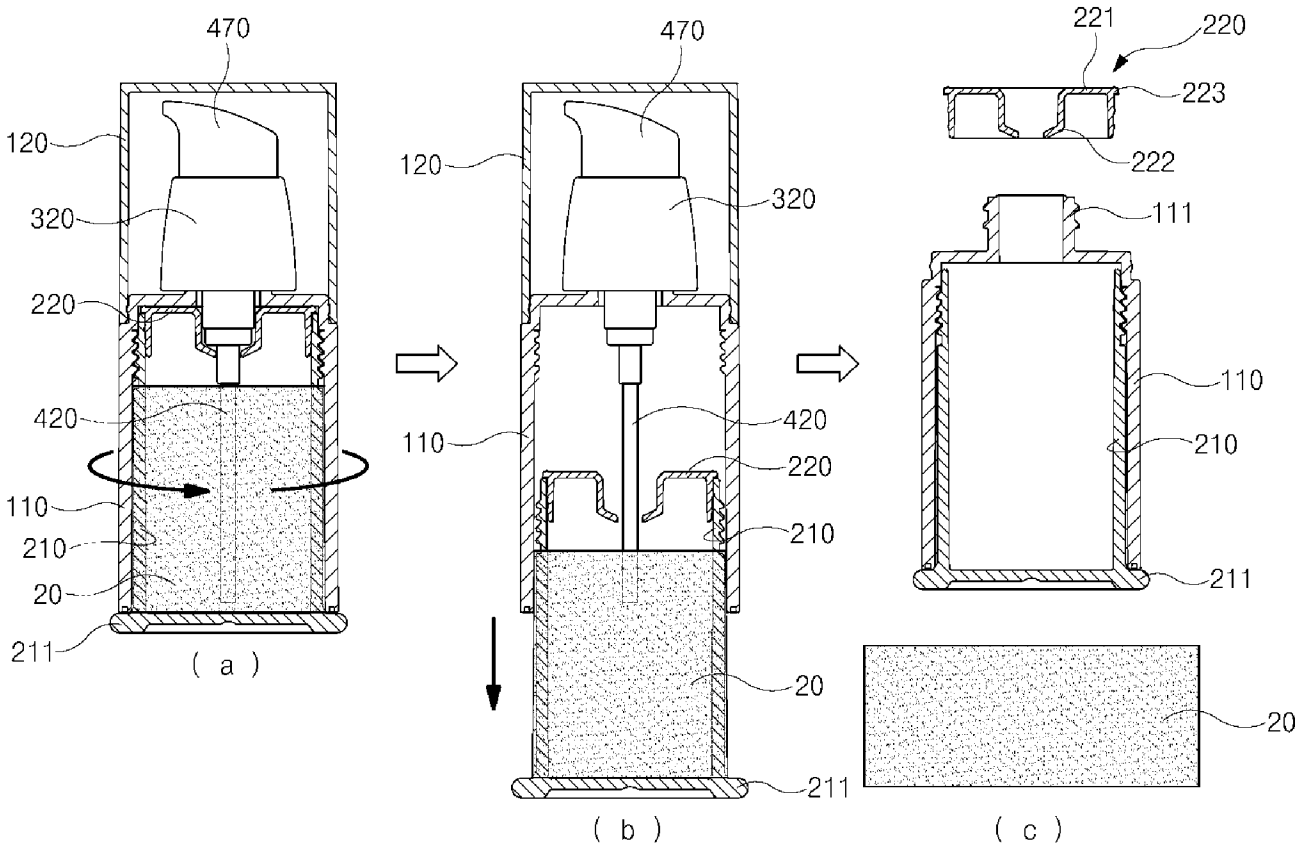
FIG. 7 is a schematic usage diagram of the embodiment.

FIG. 5 is a diagram schematically illustrating a state where a support part and a pumping driving part are separated from a container body and a cap member is excluded in FIG. 3, FIG. 6 is an exploded perspective view of the refillable container part illustrated in FIG. 4, and FIG. 7 is a schematic usage diagram of the embodiment.

As illustrated in these drawings, a refillable cosmetic container 1 according to the embodiment provides a container body 100, a refillable container part 200 which is detachably coupled to the container body 100 and in which a cosmetic liquid is stored, a support part 300 which is coupled to the other side of the container body 100, and a pumping driving part 400 which is coupled to the support part 300 to discharge the cosmetic liquid stored in the refillable container part 200 to the outside of the refillable container part 200.

As illustrated in FIG. 4, the container body 100 includes a main body 110 and a cap member 120 detachably coupled to an upper portion of the main body 110.

The main body 110 of the container body 100, as illustrated in FIG. 4, has an open lower portion, and a screw thread is provided on the upper inner wall of the main body 110, the refillable container body 210 of the refillable container part 200 may be detachably screwed.

In the embodiment, at the upper end of the main body 110, as illustrated in FIG. 4, a body head 111 is provided to have a diameter smaller than that of the main body 110, and a base body 310 of the support unit 300 may be detachably screwed to the screw thread provided on the body head 111.

In addition, in the embodiment, as illustrated in FIG. 4, a coupling protrusion 112 is provided on the upper outer wall of the main body 110, and the coupling protrusion 112 is inserted into a groove provided in the cap member 120, so that the cap member 120 may be detachably fitted to the main body 110.

Furthermore, in the embodiment, as illustrated in FIG. 3, the main body 110 is provided with a first inclined surface portion 113, and the refillable container body 210 is provided with a second inclined surface portion 212, and when the refillable container body 210 is coupled to the main body 110, the first inclined surface portion 113 and the second inclined surface portion 212 may be engaged with each other to prevent a gap between the main body 110 and the refillable container body 210.

As illustrated in FIG. 7, the refillable container part 200 is detachably coupled to the inside of the main body 110, and a film 20 is disposed between the refillable container part 200 and the main body 110, and thus, when the provided refillable container part 200 is separated and combined from and with the main body 110, the film 20 may also be separated and combined.

In the embodiment, as illustrated in FIG. 3, the refillable container part 200 includes a refillable container body 210 coupled to the inside of the main body 110 and a shifter part 220 coupled to the upper portion of the refillable container body 210.

As illustrated in FIG. 4, the refillable container body 210 of the refillable container unit 200 may be detachably screwed to the main body 110, and a cosmetic liquid may be stored in the refillable container body 210. In the embodiment, the cosmetic liquid stored in the refillable container body 210 may be discharged to the outside of the refillable container body 210 by the operation of the pumping driving part 400.

In the embodiment, as illustrated in FIG. 3, a body flange 211 is provided at the lower end of the refillable container body 210 to support the lower end of the main body 110 and limit the insertion depth of the refillable container body 210. In the embodiment, the second inclined surface portion 212 described above may be provided in a region where the refillable container body 210 and the body flange 211 contact each other.

As illustrated in FIG. 4, the shifter part 220 of the refillable container part 200 is coupled to the upper end of the refillable container body 210 to cover the open upper region of the refillable container body 210 and prevent the leakage of the cosmetic liquid stored in the refillable container body 210.

In the embodiment, as illustrated in FIG. 4, the shifter part 220 includes a shifter body 221 coupled to the upper portion of the refillable container body 210 to cover the open upper region of the refillable container body 210, an extension body 222 provided in the shifter body 221 and penetrated with a tube member 420 to cover a housing 410 of the pumping driving part 400 and prevent the cosmetic liquid from being leaked, and a support flange 223 provided at an edge of the shifter body 221 to be supported on the upper end of the refillable container body 210.

The shifter body 221 of the shifter part 220 may be detachably fitted to the upper end of the refillable container body 210. For example, as illustrated in FIG. 6, on the outer wall of the shifter body 221, a plurality of protrusions are provided in a height direction of the body of the shifter body 221 and grooves correspond to the plurality of protrusions are provided on the inner wall of the container body, so that the shifter body may be fitted by the protrusions and the grooves.

The embodiment may include a cap which is detachably coupled to the outer wall of the shifter body 221 to cover an open central portion of the extension body 222 and prevent the cosmetic liquid from being leaked through the aforementioned central portion.

As illustrated in FIG. 3, the support part 300 may be coupled to the body head 111 of the container body 100 to guide the elevation of a discharge cap 470 provided in the pumping driving part 400.

In the embodiment, as illustrated in FIG. 3, the support part 300 includes a base body 310 which is coupled to the body head 111 of the main body 110 to guide the elevation of a stem 440 of the pumping driving part 400 and limit an ascending height of a piston member 460 of the pumping driving part 400, and an elevation guide cap 320 which is coupled to the base body 310 to guide the elevation of the discharge cap 470 of the pumping driving part 400.

The base body 310 of the support part 300 may be detachably screwed to the body head 111.

In the embodiment, on the upper surface of the base body 310, as illustrated in FIG. 3, a support post 311 may be provided to protrude upward, and a lower end of an elastic member 430 may be detachably fitted to an outer wall of the support post 311.

In addition, in the embodiment, as illustrated in FIG. 5, a protrusion protruding toward the tube member 420 is provided on a bottom surface of the base body 310, and an inner wall of the housing 410 may be coupled, for example, detachably fitted to the outer wall of the protrusion by the protrusions and the grooves.

The elevation guide cap 320 of the support part 300 is fitted to the outer wall of the base body 310 or coupled to the outer wall of the base body 310 by adhesive or thermal fusion bonding to guide the elevation of the discharge cap 470 provided in the pumping driving part 400.

That is, when the pumping driving part 400 is lifted, the lower outer wall of the discharge cap 470 may be lifted while being supported on the inner wall of the elevation guide cap 320.

The pumping driving part 400 may discharge the cosmetic liquid stored in the refillable container body 210 to the outside of the refillable container body 210 by an external force of the user.

In the embodiment, the pumping driving part 400, as illustrated in FIG. 3, includes the housing 410 which is coupled to the base body 310 of the support part 300 and has a lower end which protrudes toward the bottom portion of the refillable container body 210 by passing through the shifter part 220, the tube member 420 which is coupled to the end of the housing 410 to introduce the cosmetic liquid stored in the refillable container body 210 into the housing 410 or discharge the cosmetic liquid in the housing 410 to the outside of the housing 410, the elastic member 430 having a lower side supported on the support post 311 of the support part 300, the stem 440 of which an upper side is supported on the upper end of the elastic member 430 and a lower side is supported and elevated on the base body 310 and the support post 311, the piston base 450 of which an upper end is coupled to the stem 440, a lower end is disposed in the housing 410, and a central portion is provided with an inlet hole 451 into which the cosmetic liquid is introduced, the piston member 460 provided in the piston base 450 to be in contact with the inner wall of the housing 410, the discharge cap 470 which is fitted to the stem 440 and supported and elevated on the elevation guide cap 320 of the support part 300 by the external force of the user, and is provided with a discharge passage 471 through which the cosmetic liquid moving through the inlet hole 451 is discharged to the outside, and a disk valve 480 provided on an inner bottom portion of the housing 410.

In the embodiment, as illustrated in FIG. 3, a gasket 10 may be provided between the flange of the housing 410 and the body head 111.

Hereinafter, the operation of the pumping driving part 400 will be briefly described.

When the user applies the external force to the discharge cap 470 toward the main body 110 and then releases the external force, while the contracted elastic member 430 expands, the cosmetic liquid stored in the refillable container body 210 may be introduced into the housing 410 through the tube member 420 and the disk valve 480. The cosmetic liquid introduced into the housing 410 may be supplied to the discharge passage 471 through the inlet hole 451 provided in the piston base 450 and then discharged to the outside of the discharge cap 470.

Hereinafter, a used state of the embodiment will be briefly described with reference to FIG. 7.

When replacing the refillable container part 200 of the embodiment, as illustrated in FIG. 7A, the refillable container part 200 turns counterclockwise while holding the body flange 211 of the refillable container part 200 to separate the refillable container part 200 from the main body 110.

At this time, the film 20 between the refillable container part 200 and the main body 110 may be separated together the refillable container unit 200 as illustrated in FIG. 7B.

Finally, as illustrated in FIG. 7C, the film 20 and the shifter part 220 may be separated from the refillable container body 210 and replaced with a new refillable container filled with cosmetic liquid.

As described above, the present disclosure is not limited to the embodiments described herein, and it will be apparent to those skilled in the art that various changes and modifications may be made without departing from the spirit and the scope of the present disclosure. Therefore, it will be understood that these changes and modifications are included in the appended claims of the present disclosure.

What is claimed is:

1. A refillable cosmetic container comprising:

a container body provided with a main body of which one side is opened;

a refillable container part which is detachably coupled to the main body and in which a cosmetic liquid is stored;

a support part which is coupled to another side of the main body; and a pumping driving part which is coupled to the support part to discharge the cosmetic liquid stored in the refillable container part to outside of the refillable container part, wherein the refillable container part includes a refillable container body detachably coupled to the main body and stored with the cosmetic liquid therein and a shifter part detachably coupled to the refillable container body and penetrated with a tube member of the pumping driving part, and a film is provided between the refillable container body and the main body to be easily separated when the refillable container body is separated from the main body, and wherein the shifter part includes a shifter body coupled to an upper portion of the refillable container body to cover an open upper region of the refillable container body; and an extension body provided in the shifter body and penetrated with the tube member to cover a lower side of a housing of the pumping driving part and prevent the cosmetic liquid from being leaked.

2. The refillable cosmetic container of claim 1, further comprising:

a body flange which is provided at a lower end of the refillable container body to support a lower end of the main body.

3. The refillable cosmetic container of claim 1, wherein the shifter part further includes a support flange provided at an edge of the shifter body to be supported on the upper portion of the refillable container body.

4. A refillable cosmetic container comprising:

a container body provided with a main body of which one side is opened;

a refillable container part which is detachably coupled to the main body and in which a cosmetic liquid is stored;

a support part which is coupled to another side of the main body; and a pumping driving part which is coupled to the support part to discharge the cosmetic liquid stored in the refillable container part to outside of the refillable container part, wherein the refillable container part includes a refillable container body detachably coupled to the main body and stored with the cosmetic liquid therein and a shifter part detachably coupled to the refillable container body and penetrated with a tube member of the pumping driving part, and a film is provided between the refillable container body and the main body to be easily separated when the refillable container body is separated from the main body, and wherein the support part includes a base body which is detachably coupled to a body head of the main body to guide elevation of a stem of the pumping driving part and limit an ascending height of a piston member of the pumping driving part; and an elevation guide cap which is coupled to the base body to guide elevation of a discharge cap of the pumping driving part.

5. The refillable cosmetic container of claim 4, wherein the support part further includes a support post provided on the base body to support an elastic member of the pumping driving part.

6. A refillable cosmetic container comprising:

a container body provided with a main body of which one side is opened;

a refillable container part which is detachably coupled to the main body and in which a cosmetic liquid is stored;

a support part which is coupled to another side of the main body; and a pumping driving part which is coupled to the support part to discharge the cosmetic liquid stored in the refillable container part to outside of the refillable container part, wherein the refillable container part includes a refillable container body detachably coupled to the main body and stored with the cosmetic liquid therein and a shifter part detachably coupled to the refillable container body and penetrated with a tube member of the pumping driving part, and a film is provided between the refillable container body and the main body to be easily separated when the refillable container body is separated from the main body, and wherein the pumping driving part includes:

a housing which is coupled to the support part and has a lower end which protrudes toward a bottom portion of the refillable container body by passing through the shifter part;

the tube member, which is coupled to the end of the housing to introduce the cosmetic liquid stored in the refillable container body into the housing or discharge cosmetic liquid in the housing to outside of the housing;

an elastic member having one side supported on a support post of the support part;

a stem of which one side is supported on the another side of the elastic member, another side is supported and elevated on a base body of the support part;

a piston base which has one end coupled to the stem and another end disposed in the housing, and is provided with an inlet hole into which the cosmetic liquid is introduced;

a piston member provided in the piston base to be in contact with an inner wall of the housing;

a discharge cap which is coupled to the stem and supported and elevated on an elevation guide cap of the support part by an external force of a user, and is provided with a discharge passage through which the cosmetic liquid moving through the inlet hole is discharged to the outside; and a disk valve provided on an inner bottom portion of the housing.

7. The refillable cosmetic container of claim 1, wherein the main body is provided with a first inclined surface portion, the refillable container body is provided with a second inclined surface portion, and when the refillable container body is coupled to the main body, the first inclined surface portion and the second inclined surface portion are engaged with each other to prevent a gap between the main body and the refillable container body.

* * * * *